United States Patent [19]

Losch

[11] Patent Number: 4,807,685

[45] Date of Patent: Feb. 28, 1989

[54] SEGMENTED SHUTTER OR GATE

[75] Inventor: Max H. Losch, Filderstadt, Fed. Rep. of Germany

[73] Assignee: Losch GmbH & Co., Fed. Rep. of Germany

[21] Appl. No.: 160,058

[22] Filed: Feb. 25, 1988

[30] Foreign Application Priority Data

Feb. 25, 1987 [DE] Fed. Rep. of Germany ..... 3706054

[51] Int. Cl.[4] ..... E06B 9/02

[52] U.S. Cl. ..... 160/36

[58] Field of Search ..... 160/32, 33, 35, 36, 160/201, 37

[56] References Cited

U.S. PATENT DOCUMENTS

| | | | |
|---|---|---|---|
| 3,280,888 | 10/1966 | Davis | 160/35 |
| 4,139,042 | 2/1979 | Watanabe et al. | 160/36 |
| 4,595,043 | 6/1986 | Nozawa et al. | 160/36 |
| 4,662,420 | 5/1987 | Hirao | 160/32 |

FOREIGN PATENT DOCUMENTS

| | | |
|---|---|---|
| 2703512 | 8/1978 | Fed. Rep. of Germany . |
| 3331139 | 3/1984 | Fed. Rep. of Germany . |
| 3348061 | 9/1984 | Fed. Rep. of Germany . |
| 610054 | 3/1979 | Switzerland . |

*Primary Examiner*—Ramon S. Britts
*Assistant Examiner*—David G. Kolman
*Attorney, Agent, or Firm*—Thomas W. Speckman

[57] ABSTRACT

A segmented shutter or gate with a plurality of gate segments which have dowels on both sides in the area of the upper edge and in the area of the lower edge of the gate segment. The upper dowels are connected in an articulated manner with transporting chains guided along vertical guide rails and driven by chain wheels which transfer the ends of the upper dowels onto storage rails. The lower dowels ride over control cams horizontally moving the lower portion of the gate segment toward the storage rails to allow the next lowermost gate segment to proceed upwardly with the transporting chain.

22 Claims, 3 Drawing Sheets

SEGMENTED SHUTTER OR GATE

BACKGROUND OF THE INVENTION

1. Field of the Invention

The invention concerns a segmented shutter or gate with several plate segments extending over the width of the gate and individually attached to laterally spaced transporting chains. In the closed position of the segmented shutter or gate, the gate segments are placed in a clamped position on top of one another. In the open position the gate segments are suspended, positioned in rows behind one another on storage rails which are located behind a building slab plate or an opening. The gate segments have dowels on both sides in the area of the upper edge of the gate segment. The dowels are connected in an articulated manner with transporting chains which are guided along vertical guide rails and are driven by chain wheels. The chain wheels transfer the ends of the dowels onto the storage rails.

2. Description of the Prior Art

In conventional segmented shutters or gates of the type described above, such as described, for example in German Patent Publication DE-OS No. 27 03 512, the gate segments are connected in an articulated manner with the chains and horizontally directed by means of two guide rollers. The opening of the gate occurs in such a manner that two chain wheels upwardly move the chains supporting the gate segments. When the individual gate segments reach the area of the chain wheels, they no longer move vertically upward, but rather obliquely sideways upward or downward, so that both the upper as well as the lower, horizontally directed edge of the gate segments have a circular motion. Such a course of motion of the gate segments is regularly ensured if the chain wheels have a diameter which is relatively large in relation to the height of the gate segments. This can lead, however, to an undesirably large storage unit.

The rapid up and down movement of the gate presupposes that, in the turnaround area of the gate segments, the gate segments cannot come into contact with one another in an uncontrolled manner since to do so, the up and down movement not only creates considerable noise but also creates the danger that the gate segments will carry out swinging motions which can be transferred to the storage unit in the form of vibrations.

Proceeding from the above state of the art, the task which forms the basis of the invention is that of developing a segmented shutter or gate of the type described above without undue constructive expense and with secure, noise-free opening and closing even when the height of the storage unit is lower.

SUMMARY OF THE INVENTION

The problem is solved in this invention by having gate segments with dowels on both sides in the area of the lower gate segment edge. Below the chain wheels are control cams, used to direct the lower dowels, the control cams being located in planes defined by the vertical guide rails and the storage rails. The control cams extend from the storage rails to the vertical guide rails. The distance from the initial chain turnaround points of the chain wheels at the vertical rails to the control cams cannot be greater than the distance between the upper and lower dowels.

This invention includes transition areas located where the lower portions of the control cams and the vertical storage rails meet. Such transition areas are designed to direct the lower dowels toward the storage area by deflecting the lower, horizontally proceeding edges of the gate segments inwardly toward the storage area. As the lower dowels progress through the transition area, the upper dowels progress around the chain wheels and thus horizontally position the smaller sides of the generally board-shaped gate segments. In such position, the gate segments occupy little horizontal space because of the slight thickness of the gate segments. Thus, the advantage of this invention is that storing the gate segments with the line formed by the dowels in the vertical position ultimately decreases the distance between the adjoining gate segments.

This construction also ensures that during the opening process of the gate the individual gate segments never come into uncontrolled contact with one another. This orderly transition also allows the opening and closing of the gate with low noise levels. Since the diameter of the chain wheels can be reduced, it is also possible to reduce the overall height of the storage unit.

This invention has further suitable and advantageous measures.

This invention involves gate segments storage units with gate segments that have open ends and are constructed as hollow profile sections. The dowels can be connected to blocks which can be connected to the gate segments in a force-locking manner to close the ends. The blocks with their dowels cooperate with the vertical guide rails and storage rails. Such construction of this invention makes it possible to not only construct the gate segments and connect them with one another, but also with the blocks and dowels.

Through form-locking and force-locking connection of the blocks with the gate segments, it is ensured that the dowels have the same properties as dowels which are connected with the gate segments directly, that is to say, for example, in a single piece. If the width of the blocks approximately equals the thickness of the gate segments, then the guidance of the gate segments along the vertical guide rails takes place in a frictionless manner. Such blocks can be made of various materials, however, it is advantageous if they are made of plastic since movement of plastic blocks with the vertical guide rails produces no excessive noise level. In addition, plastic blocks are easy to manufacture.

In order to move the gate segments, an inward swing of the lower part of the specific gate segment must occur. Such inward swing will occur when the lower dowels ride against the control cams. Movement of the lower dowel against the control cam will also reduce the noise level. One embodiment of the invention provides casings over the lower dowels which can roll on the control cams.

In order to be able to shift the lower part of the specific gate segment inward as rapidly as possible, this invention provides for control cams that have an inlet part as well as a deflection part. It is suitable if the angle defined by the inlet part and a vertical amounts to approximately 45°. The angle must, on the one hand, be steep enough that the lower edge of the specific plate can swing out as rapidly as possible, but, on the other hand, care must be taken to assure no swinging or bending of the dowels. Swinging or bending of the dowels may occur if the inlet part were to run perpendicularly to the vertical guide rails.

In regard to the design of the control cam, one part of its body can be connected with the vertical guide rail or the storage rail. In its simplest form of construction, the body of the control cam can be plate-shaped and essentially have the form of a triangle.

BRIEF DESCRIPTION OF THE DRAWINGS

One embodiment of this invention is schematically shown in the drawings, wherein.

DESCRIPTION OF THE PREFERRED EMBODIMENTS

Figure 3:
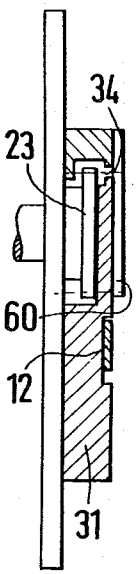
FIG. 3 shows a section along the line III—III in with FIG. 1.
Figure 1:
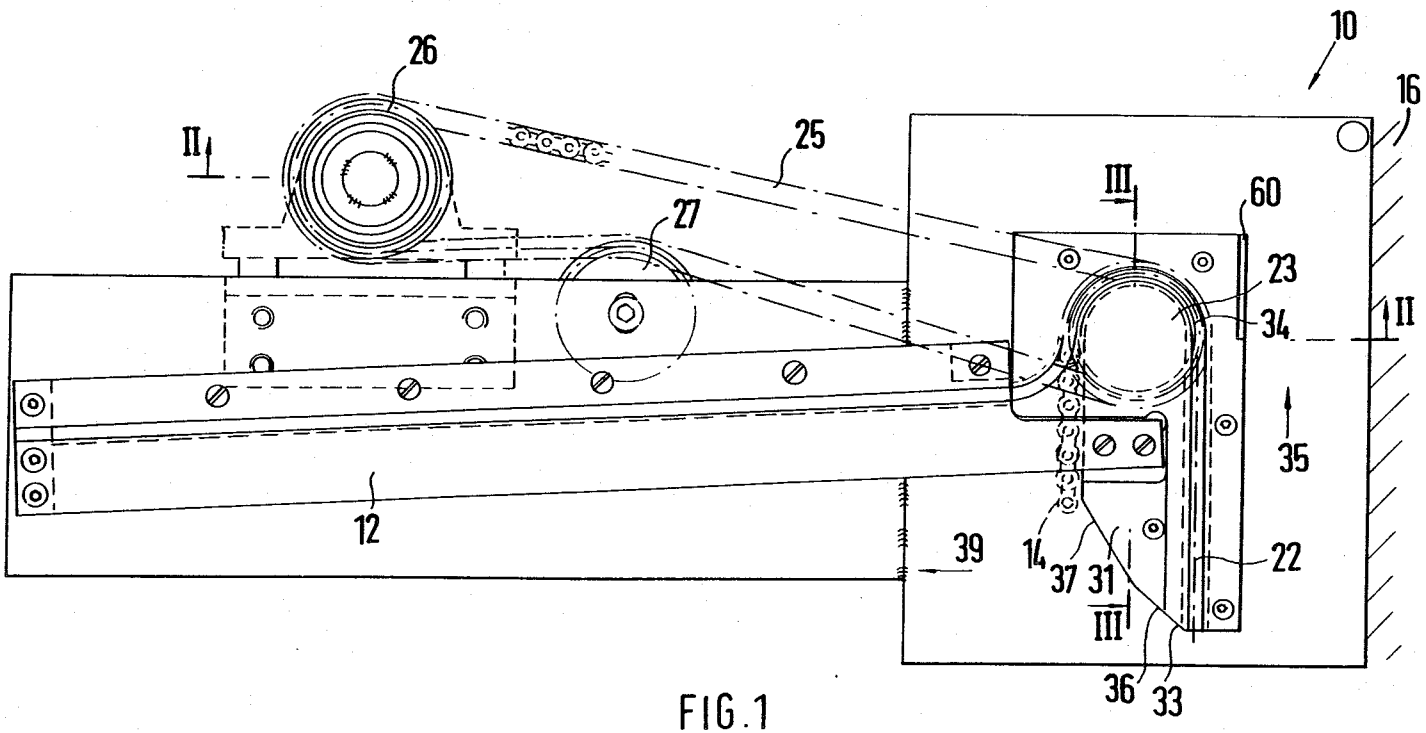
FIG. 1 shows a side view of a turnaround point as well as a storage unit in a plates-gate.
Figure 2:
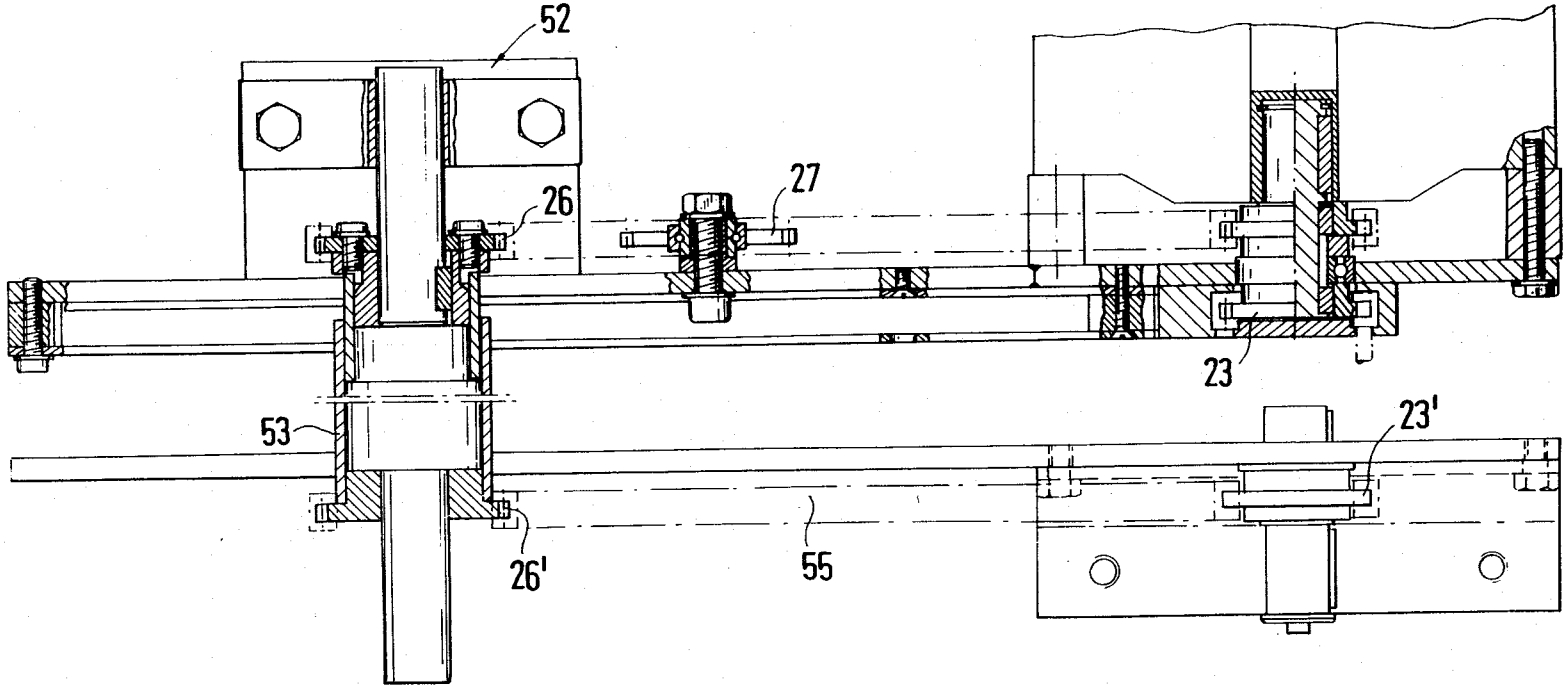
FIG. 2 a partial cross section along the line II—II in accordance with FIG. 1.

The form of execution of the invention shown in FIGS. 1 and 2 shows essentially one turnaround point (10) and one storage rail (12) of a segmented gate having several gate segments (not shown in FIG. 1) which extend over the width of the gate. The gate segments are individually attached to laterally arranged transporting chains (14). In the closed position of the gate, the gate segments stand in a clamped position on top of one another. In the open position of the gate, the gate segments are suspended, positioned in rows behind one another on storage rails (12) which are located behind a building slab plate (16) or an opening. Each gate segment has dowels (19 and 20) on both sides of the gate segment located in the area of the upper plate edges (17) and the lower plate edges (18). The dowels (19) are connected in an articulated manner with the transporting chains (14) which follow the vertical guide rails (22). The chain wheels (23) move the dowels (19) onto the storage rails (12). The chain wheels (23) are connected with a chain wheel (26) by means of an additional chain (25). Chain wheel (26) is driven directly by a motor. The desired tension of the chain (25) can be achieved by means of an adjustable chain wheel (27).

Below the chain wheel (23), a control cam (31) for the lower dowels (20) extends from the storage rail (12) to the vertical guide rail (22). The distance of the transition area (33) from the chain turnaround point (34) of the chain wheel (23) defined by the vertical rail (22) and the control cam (31) is smaller than the distance x, as shown in FIG. 5.

Figure 5:
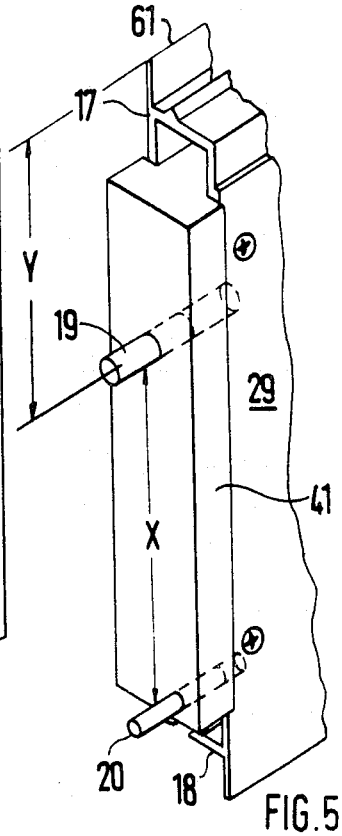
FIG. 5 shows an end of a segmented gate section with a block.

If the gate segment (29), as shown in FIG. 5, supported by the chain (14) now moves in the direction of the arrow (35), that is to say, upwardly, and when the dowel (19) passes the area of the chain turnaround point (34), then the dowel (20) is guided along the inlet part (36) of the control cam (31). The inlet part (36) is so constructed that the lower plate edge (18) of the gate segment (29) is moved in the direction of the arrow (39). This has the result that the following gate segment (not further shown) does not come into contact with the previous gate segment, and the following gate segment can also reach the chain turnaround point (34). The measure of the angle which the inlet part of the vertical guide rail (22) depends on the diameter of the chain wheel (23).

FIG. 5 shows that the dowels (19 and 20) can be connected in a detachable manner with a block (41) which closes the on end of the gate segment (29). Block (41) can be connected with the gate segment (29) in a form-locking or force-locking manner. Block (41) is sized to cooperate with the vertical guide rails (22) and storage rails (12). The width of the block (41) approximately equals the thickness of the gate segment (29).

The lower dowel (20) may have a covering which can roll on the control cam (31).

The control cam (31) has a body which can be connected with the vertical guide rail (22) or the storage rail (12). The body of control cam (31), as shown in the drawing, is plate-shaped and essentially triangular. The control cam (31) has an inlet part (36) and a deflection part (37). In the embodiment shown, the angle defined by the inlet part (36) and the vertical amounts to about 45°. The greatest horizontal dimension of the control cam (31) is so dimensioned that it approximately corresponds to the diameter of the chain wheel (23).

Figure 4:
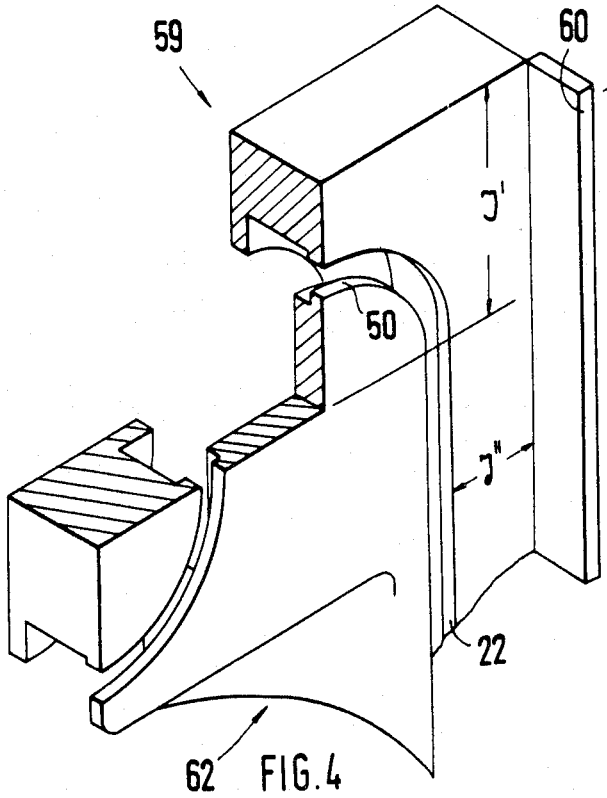
FIG. 4 shows one part of the turnaround area, partially cut away and in exposed depiction.

The turnaround area depicted in FIG. 4 shows that, in the area of the chain wheel (23), the guide surfaces (50) for the upper dowels (19) have the same curvature radius as the chain wheel (23). The transition and turnaround area can be constructed from the same assembly parts, so that the parts subjected to the greatest forces can be changed at any time. As a result, the down-time of the gate segments (29), which can be expected with repeated inspection and repairs, is reduced.

It further proceeds from FIG. 2 that an electric motor (52), which drives the chain wheel (26), drives an additional chain wheel (26') by means of a shaft (53). Chain wheel (26') is connected with additional chain wheel (23') by means of a chain (55). The chain wheels (26 and 26' and 23 and 23') are so selected that the conversion is uniform, so that the chain wheels (23 and 23') have the same rotational speed.

Finally, FIGS. 4 and 5 show that the control cam (62) is rounded and has a curvature which is, at the most, as great as the curvature of the chain turnaround point (34).

The chain turnaround point (34) is one part of a housing (59) which accommodates the chain wheel (23). One side of housing (59) runs parallel to the vertical guide rail (22). The vertical guide rail (22) has a counter-support (60), which runs approximately parallel with the gate segments (29 and extends vertically upwards from about the level of the chain turnaround point (34). The height (y') of the counter-support (60) is greater than or equal to the distance (y) from the upper dowel (19) to the upper edge (61) of the gate segment (29).

The distance (y'') from the counter-support (60) to the vertical rail (22) is less than (y). The counter-support (60) is plate-shaped and can be connected with the housing (59) in a detachable manner. Through these dimensions, it can particularly be determined that the gate segments (29), during movement into their active position, can only have limited swinging movements in the area of the chain turnaround parts. In the area of the chain turnaround, the counter-support (60) acts as a guide body against which the upper edges of the plates can follow.

I claim:

1. A segmented shutter or gate storage unit having a plurality of gate segments extending over the width of the gate and individually attached to laterally spaced transporting chains, said gate segments, in the closed position of said segmented shutter or gate, are placed in a clamped position on top of one another, and in the open position said gate segments are suspended and positioned in rows behind one another on storage rails behind a building slab plate or an opening, said gate segments have upper dowels on both sides in the area of the upper edge of said gate segment, said upper dowels connected in an articulated manner with said transporting chains, said transporting chains arranged in vertical guide rails and are powered by driven chain wheels, whereby said chain wheels transfer the ends of said upper dowels onto said storage rails, the improvement comprising: said gate segments (29) having lower dowels (20) on both sides of said gate segments (29) in the area of the lower border (18) of said gate segment (29) there being a defined distance (X) between said upper and lower dowels (19, 20); below said chain wheels (23) are control cams (31) which guide said lower dowels (20), said control cams (31) formed in the planes defined by said guide rails (22) and said storage rails (12) and have a transition area (33) where said vertical guide rails (22) meet control cam (31), the distance between said transition area (33) and chain turnaround points of said chain wheels (23) is not greater than said distance (X).

2. A segmented gate storage unit in accordance with claim 1, having said gate segments (29) open on the ends formed with hollow profile sections, wherein said dowels (19, 20) are connected in a detachable manner with blocks (41) which seal the ends of said gate segments (29) and said blocks can be connected with said gate segments in a form-locking or force-locking manner.

3. A segmented gate storage unit in accordance with claim 2, wherein the thickness of said blocks (41) approximately equals the thickness of said gate segments (29).

4. A segmented gate storage unit in accordance with claim 3, wherein said lower dowels (20) have a covering which can roll on said control cams (31).

5. A segmented gate storage unit in accordance with claim 4, wherein said control cams (31) have connecting means connectable to said vertical guide rails (22) or said storage rails (12).

6. A segmented gate storage unit in accordance with claim 5, wherein the body of said control cams (31) are plate-shaped and essentially triangular.

7. A segmented gate storage unit in accordance with claim 6, wherein said control cam (31) has an inlet portion (36) and a deflection portion (37).

8. A segmented gate storage unit in accordance with claim 7, wherein the angle defined by said inlet portion (37) and the vertical is about 45°.

9. A segmented gate storage unit in accordance with claim 8, wherein the length of said control cam (31) measured in the horizontal plane approximately equals the diameter of said chain wheel (23).

10. A segmented gate storage unit in accordance with claim 5, wherein a control cam (62) located at the lower portion of said chain wheels (23) is circular and has a curvature no greater than the curvature of said chain turnaround point (34).

11. A segmented gate storage unit in accordance with claim 10, wherein said chain turnaround point (34) is a part of a housing (59) which accommodates said chain wheel (23), said housing having one side running in parallel to said vertical guide rail (22), said side having a counter-support (60) which runs approximately parallel with said gate segments (29) and which extends vertically upward from said chain turnaround point (34), the height (y') of said counter-support (60) exceeds or equals the distance (y) from said upper dowel (19) to said upper edge (61) of said gate segment (29).

12. A segmented gate storage unit in accordance with claim 11, wherein the distance (y'') from said counter-support (60) to said vertical rails (22) is less than said distance (y).

13. A segmented gate storage unit in accordance with claim 12, wherein said counter-support (60) is plate-shaped and connected in a detachable manner with said housing (59).

14. A segmented gate storage unit in accordance with claim 1, wherein the thickness of said blocks (41) approximately equals the thickness of said gate segments (29).

15. A segmented gate storage unit in accordance with claim 1, wherein said lower dowels (20) have a covering which can roll on said control cams (31).

16. A segmented gate storage unit in accordance with claim 1, wherein said control cams (31) have connecting means connectable to said vertical guide rails (22) or said storage rails (12).

17. A segmented gate storage unit in accordance with claim 1, wherein the body of said control cams (31) are plate-shaped and essentially triangular.

18. A segmented gate storage unit in accordance with claim 1, wherein said control cam (31) has an inlet portion (36) and a deflection portion (37).

19. A segmented gate storage unit in accordance with claim 1, wherein the angle defined by said inlet portion (37) and the vertical is about 45°.

20. A segmented gate storage unit in accordance with claim 1, wherein the length of said control cam (31) measured in the horizontal plane approximately equals the diameter of said chain wheel (23).

21. A segmented gate storage unit in accordance with claim 1, wherein a control cam (62) located at the lower portion of said chain wheels (23) is circular and has a curvature no greater than the curvature of said chain turnaround point (34).

22. A segmented gate storage unit in accordance with claim 1, wherein said chain turnaround point (34) is a part of a housing (59) which accommodates said chain wheel (23), said housing having one side running in parallel to said vertical guide rail (22), said side having a counter-support (60) which runs approximately parallel with said gate segments (29) and which extends vertically upward from said chain turnaround point (34), the height (y') of said counter-support (60) exceeds or equals the distance (y) from said upper dowel (19) to said upper edge (61) of said gate segment (29).

* * * * *